US006527293B1

(12) United States Patent
Roy et al.

(10) Patent No.: US 6,527,293 B1
(45) Date of Patent: Mar. 4, 2003

(54) BINDING FOR A SNOW-SPORT DEVICE

(76) Inventors: Jean-Michel Roy, 684, Route de la Gare, 58130 Urzy (FR); Michel Mercier, Rue de Fond Bernard, 38500 Voiron (FR)

( * ) Notice: Subject to any disclaimer, the term of this patent is extended or adjusted under 35 U.S.C. 154(b) by 0 days.

(21) Appl. No.: 09/596,884

(22) Filed: Jun. 20, 2000

(30) Foreign Application Priority Data

Jun. 22, 1999 (FR) ..... 99 08114

(51) Int. Cl.[7] ..... A63C 9/06

(52) U.S. Cl. ..... 280/624; 280/619; 280/623; 280/625

(58) Field of Search ..... 280/617, 618, 280/607, 619, 611, 623, 625, 634, 616, 622, 620, 636, 624, 613, 14.22, 14.24

(56) References Cited

U.S. PATENT DOCUMENTS

| | | | | | |
|---|---|---|---|---|---|
| 3,635,485 | A | * | 1/1972 | Gertsch et al. | 280/11.35 |
| 3,888,499 | A | * | 6/1975 | Gertsch et al. | 280/11.35 |
| 3,924,868 | A | * | 12/1975 | Koos | 280/11.35 |
| 3,950,001 | A | * | 4/1976 | Weigl | 280/11.35 |
| 3,971,567 | A | * | 7/1976 | Sittmann | 280/618 |
| 4,023,824 | A | * | 5/1977 | von Besser | 280/618 |
| 4,050,716 | A | * | 9/1977 | Kubelka et al. | 280/614 |
| 4,142,734 | A | * | 3/1979 | Bentley | 280/615 |
| 4,156,535 | A | * | 5/1979 | von Besser et al. | 280/618 |
| 4,157,191 | A | * | 6/1979 | Ramer | 280/614 |
| 4,168,084 | A | * | 9/1979 | von Besser et al. | 280/618 |
| 4,188,046 | A | * | 2/1980 | Fleckenstein | 280/618 |
| 4,620,375 | A | * | 11/1986 | Wallace | 36/7.6 |
| 4,856,808 | A | * | 8/1989 | Longoni | 280/617 |
| 4,871,186 | A | * | 10/1989 | Klosterman | 280/611 |
| 4,887,833 | A | * | 12/1989 | Bailey | 280/615 |
| 5,044,654 | A | * | 9/1991 | Meyer | 280/613 |
| 5,172,924 | A | * | 12/1992 | Barci | 280/14.2 |
| 5,794,362 | A | * | 8/1998 | Polk, III et al. | 36/97 |
| 5,909,886 | A | * | 6/1999 | Tugutaka et al. | 280/14.2 |
| 5,915,721 | A | * | 6/1999 | Laughlin et al. | 280/617 |
| 6,007,077 | A | * | 12/1999 | Moe | 280/14.2 |
| 6,105,995 | A | * | 8/2000 | Zill | 280/617 |
| 6,116,634 | A | * | 9/2000 | Mometti | 280/613 |
| 6,195,919 | B1 | * | 3/2001 | Forrest et al. | 36/122 |
| 6,293,577 | B1 | * | 9/2001 | Shields | 280/617 |

FOREIGN PATENT DOCUMENTS

| | | | | |
|---|---|---|---|---|
| DE | 4016137 | A1 * | 11/1990 | A63C/9/00 |
| FR | 0671190 | A1 * | 9/1995 | A63C/13/00 |
| FR | 2717093 | A | 9/1995 | |
| FR | 2717093 | A1 * | 9/1995 | A63C/13/00 |
| FR | 2760377 | A | 9/1998 | |

* cited by examiner

*Primary Examiner*—Brian L. Johnson
*Assistant Examiner*—J. Allen Shriver

(57) ABSTRACT

A binding comprising a base plate (1) carrying, for holding a boot, front retention (2) and a heelpiece (7) mounted slidably on the base plate, and a traction strap (16) acting on the heelpiece in order to pull it forward. The base plate (1) is equipped with a rack (6), and the heelpiece (7) is equipped with two levers (11, 12), the lower arms of which are connected to the ends of a small arch (15) which hooks into the rack. The upper arms of the levers are connected to the traction strap (16) which is intended to pass diagonally over the instep of the boot. The pressure on the small arch makes it possible to increase the force of the forward thrust and the heel of the boot is pressed against the base plate.

15 Claims, 6 Drawing Sheets

BINDING FOR A SNOW-SPORT DEVICE

BACKGROUND OF THE INVENTION

The present invention relates to a binding for a snow-sport device, such as a short ski, short cross-country ski, snowshoe or snowboard, comprising a base plate which, for holding a boot, has front retention means and rear retention means consisting of a heelpiece mounted slidably on the base plate and a traction strap acting on the heelpiece in order to pull it toward the front retention means.

A binding of this type is known, for a snowshoe, from Patent FR 2 717 093, the content of which is incorporated by reference. In this binding, the rear retention means consist of a shoe block sliding freely over a base plate, this shoe block being pulled forward by a strap attached under the shoe block, and connected to a front cover articulated on a stirrup piece fixed to the front of the plate and constituting a front stop. Connected to the sliding shoe block is a second strap passing over the instep in order to press the heel of the boot onto the base plate. Two actions on two different straps are therefore necessary, one in order to fix the boot longitudinally on the base plate and the other to press the heel of the boot onto the base plate. Moreover, in the absence of a boot, the sliding shoe block can move freely along the base plate and it is consequently impossible to preserve presettings of the position of this shoe block on the base plate.

SUMMARY OF THE INVENTION

The object of the invention is to simplify and to improve the operation of fitting the device to a boot and the tightening of a binding of this type and, simultaneously, to obtain presetting of the rear retention means.

The binding according to the invention is defined in that the base plate is equipped with a rack over a portion of its length and in that the heelpiece is equipped, on each side, with a lever articulated at an intermediate point on the heelpiece about an axis transverse to the base plate, the lower arms of these levers being connected to the ends of a small arch which hooks into the rack of the base plate, and the upper arms of the levers being connected to the traction strap which is intended to pass diagonally over the instep of the boot.

One and the same strap pushes the heelpiece forward and presses the heel against the base plate. In the tightened position, the articulations of the lower lever arms on the small arch engaged in the rack of the base plate actually convert into fixed points and the levers then work as second-class levers about these fixed points. The diagonal force exerted by the strap passing over the instep is thus multiplied on the articulation axis of the levers on the heelpiece. The force on the instep may therefore be maintained within reasonable limits, without unpleasant pressure on the instep, while pushing the heelpiece forward to a considerable extent, i.e. excellent holding of the boot in the longitudinal direction. These forces may be modified by adjusting the length of the lever arms.

The dual function of the small arch will also be noted. On the one hand, it makes it possible to preserve presetting of the position of the heelpiece, and, on the other hand, it serves as a support point for the levers of the heelpiece.

When the small arch is engaged in a particular notch of the rack, when no boot is fitted in the device, the heelpiece may be withdrawn until the small arch occupies a position parallel to the plane of the base plate. This easily makes it possible for the heelpiece to travel a distance of the order of 25 mm, which is more than sufficient for easy and comfortable fitting of the device to a boot. When no boot is fitted in the device, the adjustment is preserved and the heelpiece is unable to move freely over the base plate.

The maximum amplitude of the displacement of the points of articulation of the small arch on the levers during rotation of this lever is advantageously greater than the pitch of the rack. The small arch may thus occupy two different positions for one and the same boot size, and continuous adjustment is obtained together with the guarantee of satisfactory tightening.

The front retention means may consist of a simple strap. This will be the case, for example, for a snowboard binding.

The front retention means may consist of a fixed stop providing only longitudinal holding. In this case, the binding comprises intermediate retention means consisting, for example, of a strap.

Generally speaking, the binding according to the invention, which is nonreleasable, is intended for sports devices which do not require such a release capability.

BRIEF DESCRIPTION OF THE DRAWINGS

The appended drawing shows, by way of example, an embodiment of a binding according to the invention.

DETAILED DESCRIPTION OF THE PREFERRED EMBODIMENT(S)

Figure 1:
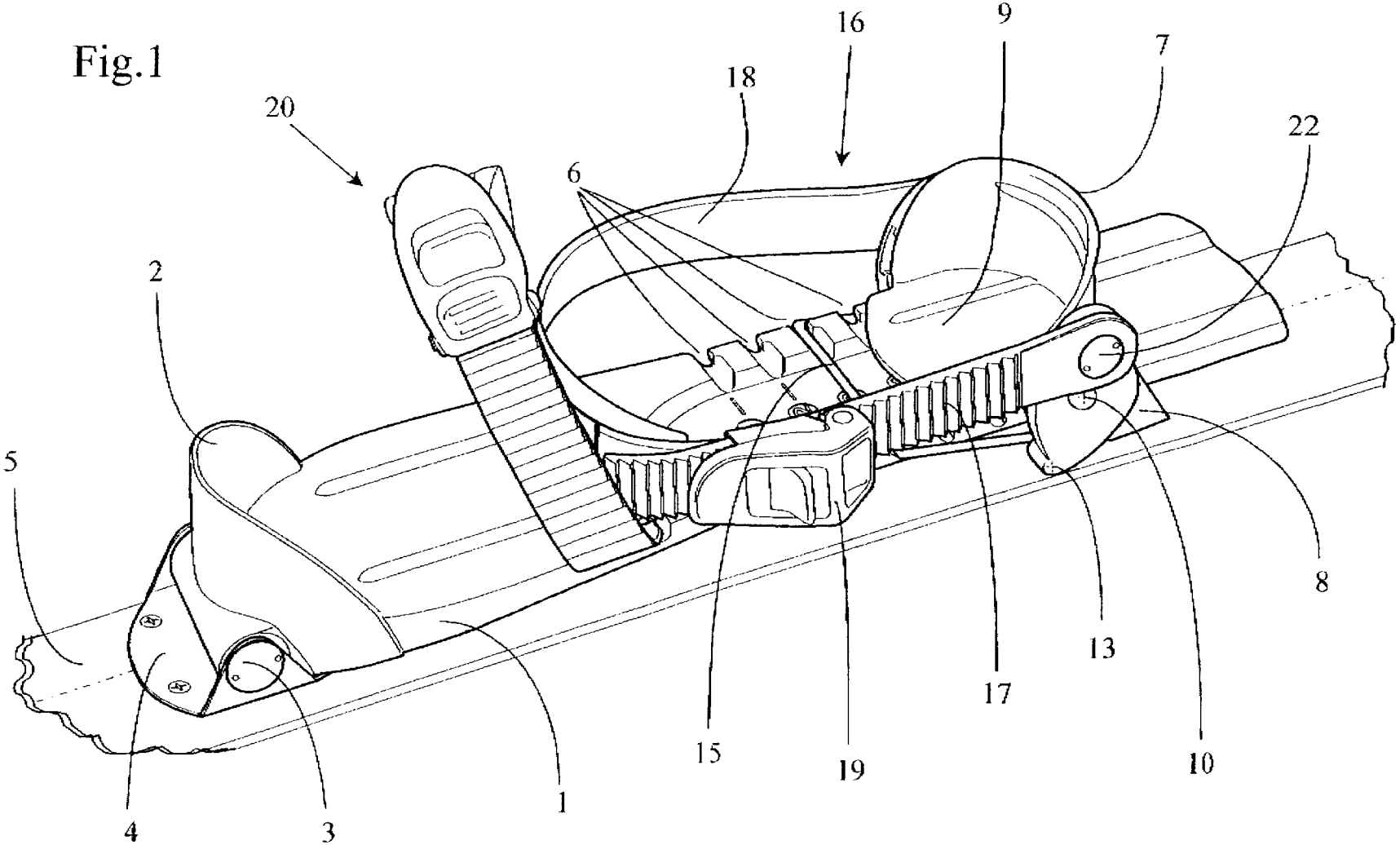
FIG. 1 shows a perspective view of a binding.
Figure 2:
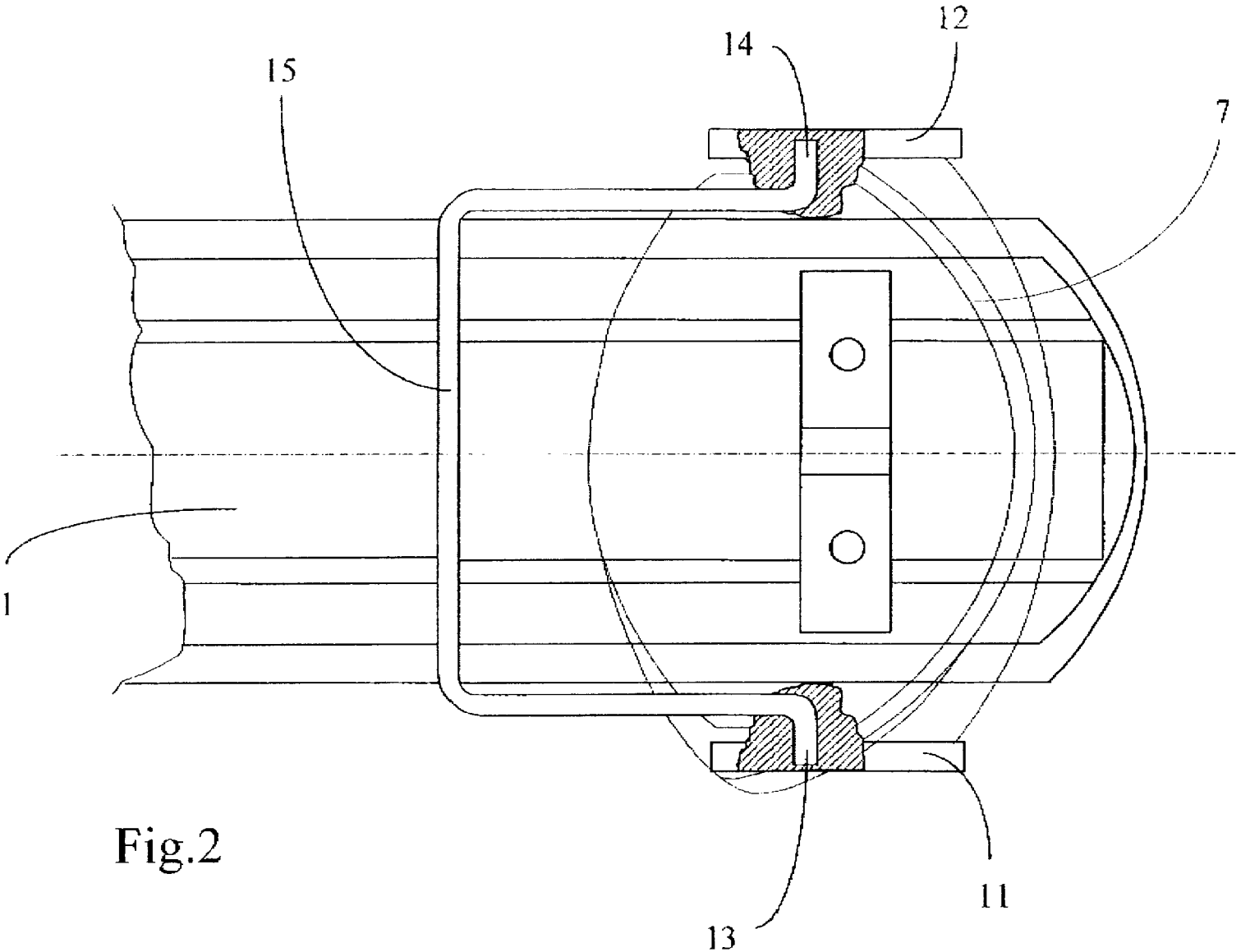
FIG. 2 is a plan, top view of the rear part.

The binding comprises a base plate 1 made in a single piece with a front stop 2 in the form of a vertical wall which is curved so as to match the shape of the front end of a boot. The plate 1 is made from lightweight metal or from injected synthetic material. In the example shown, this plate is articulated at the front about a pin 3 on a small plate 4 in the form of a stirrup piece, this small plate itself being fixed onto a ski 5. The base plate 1 has, on its upper face, a rack 6 having five oblique recesses distributed in two parallel rows. These recesses are preferably curved so as better to carry out their retention role.

At the rear, the base plate 1 carries a heelpiece 7 mounted slidably on the base plate 1. To this end, the heelpiece 7 is equipped with a stirrup piece 8 rigidly connected to the heelpiece 7 and passing under the base plate 1. The heelpiece 7 has, just like the front stop 2, a vertical wall which is curved so as to match the rounded heel of the boot. This vertical wall rises up from a planar base 9. Two coaxial pivots, with an axis 10, are formed on the sides of the stirrup piece 8 and carry two levers of the first kind 11 and 12, which are identical, parallel and symmetrical relative to the vertical plane passing through the longitudinal axis of the base plate 1. Levers 11 and 12 are articulated, near the lower end of the lever arms, on the bent ends 13 and 14 of a rectangular small arch 15 consisting of a circular-section steel wire. This small arch 15 is intended to hook into one of the notches of the rack 6. The upper arm of the levers 11 and 12 is attached and articulated, at a point 22, on the ends of a strap 16 consisting of a notched belt 17 and of a belt 18 equipped with a pawl 19 intended for engaging in the notches of the notched belt 17. A strap of this sort is well known in the field of sports footwear and bindings.

Between the front stop 2 and the heelpiece 7, the base plate 1 is equipped with a second strap 20 similar to the strap 16.

The operation and the advantages of the binding will become apparent in the description of a sequence in which the device is fitted to a boot, this being made in connection with FIGS. 4 to 7.

Figure 3:
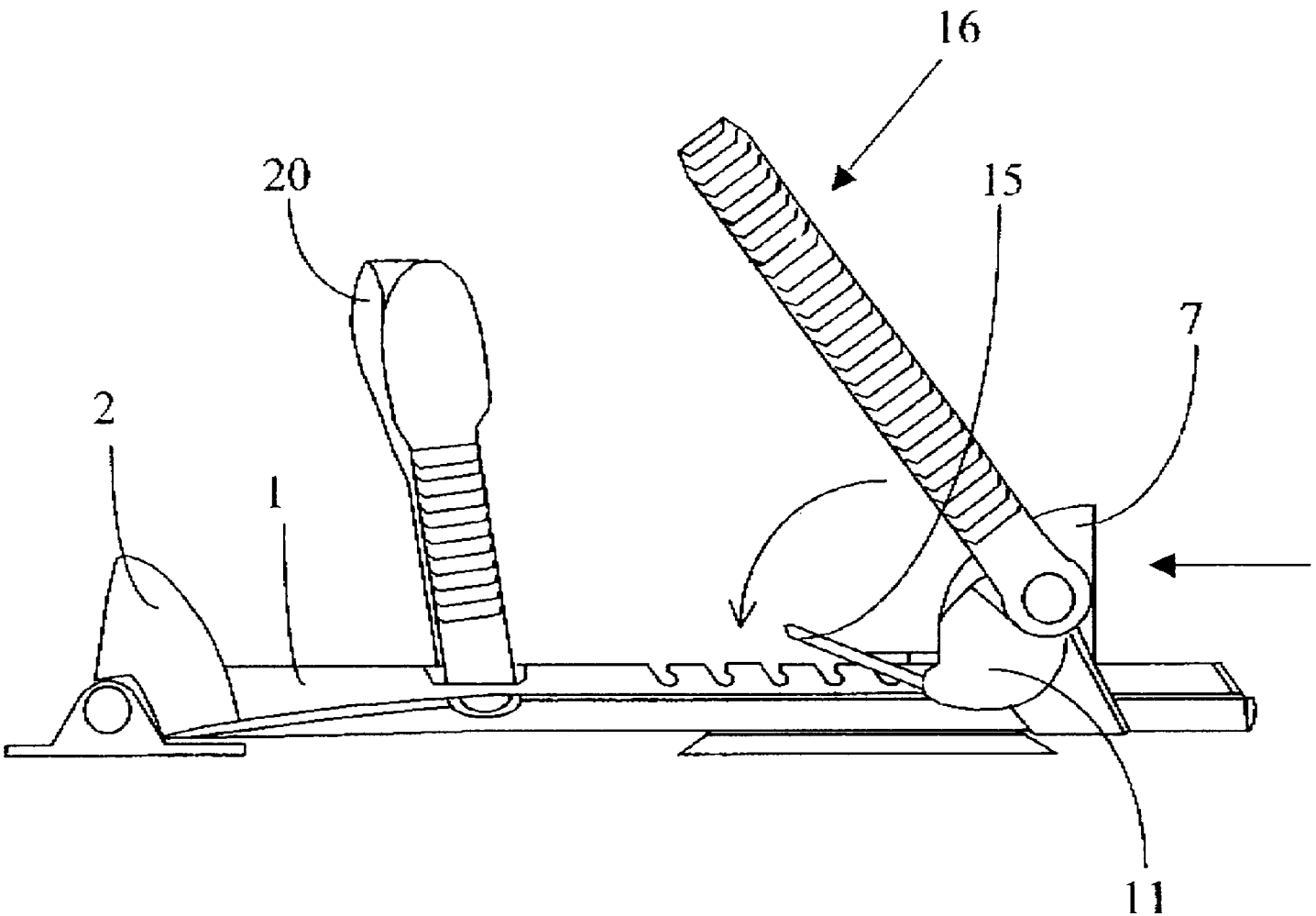
FIGS. 3 to 6 illustrate four successive phases of a sequence of fitting the device to a boot.

FIG. 3 illustrates the preparation and presetting of the binding. It would be more correct to speak of preadjustment of the binding to the size of the boot used. The strap 20 is closed, but unextended. The strap 16 is open. The stirrup piece 15 is released from the rack in such a manner that the heelpiece 7 is able to move freely along the base plate 1. Depending on the boot size, the values of which are indicated on the base plate, the small arch 15 is engaged in one of the notches of the rack 6. If, for example, the rack has an 18-mm pitch, the small arch 15 may occupy two positions in the rack 6 for the same boot size. In other words, the amplitude of displacement of the points of articulation of the small arch 15 on the levers 11 is greater than the pitch of the rack. This allows continuous adjustment and makes the binding very flexible to use.

Figure 4:
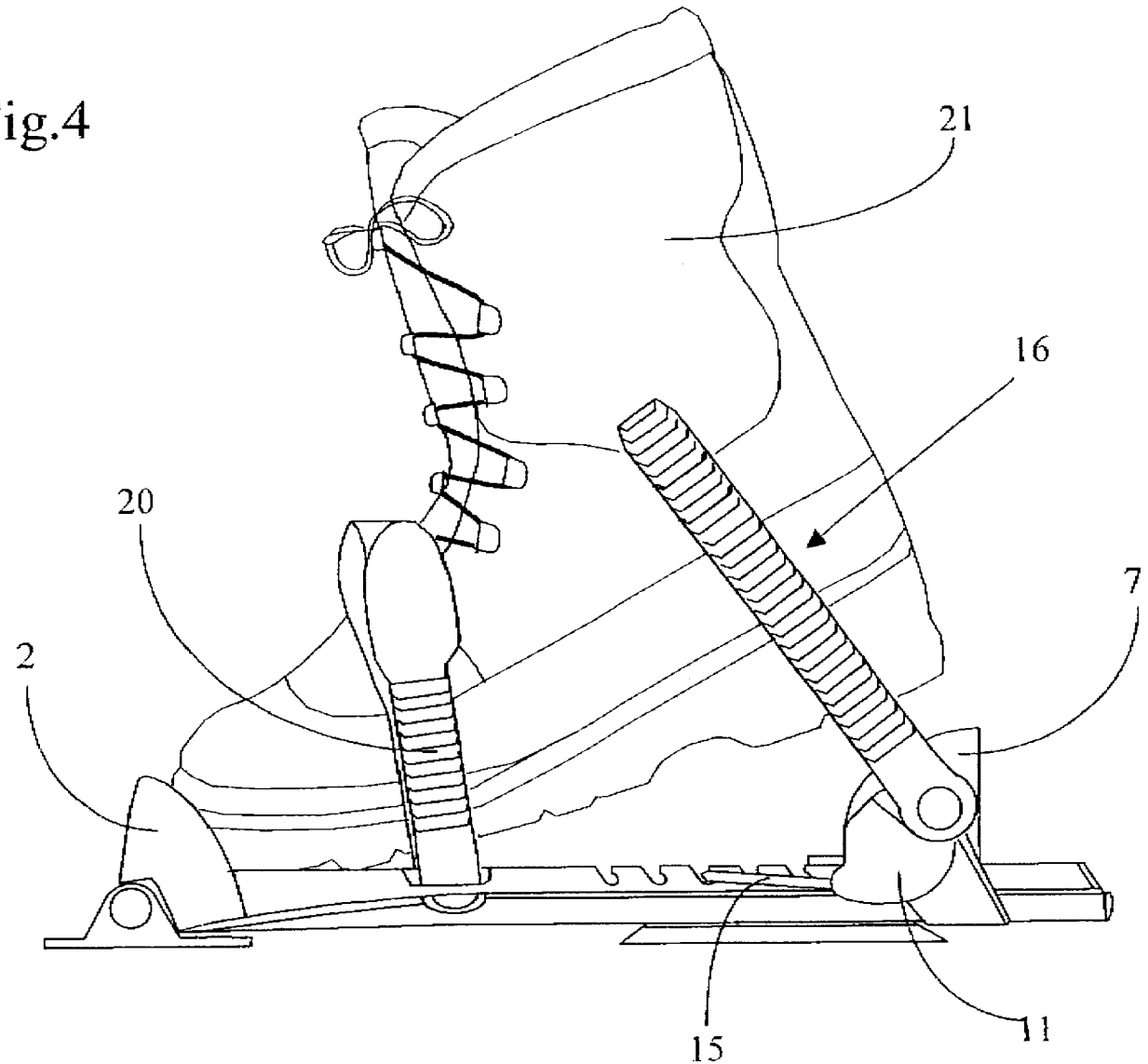

Once the small arch 15 has engaged in the rack 6, the heelpiece 7 may be pulled backward into its extreme position, as shown in FIG. 4. In this position, the small arch 15 is parallel to the plane of the base plate 1. The boot 21 is then inserted under the strap 20 in a natural position which is slightly tilted forward, until it abuts against the front stop 2.

Figure 5:
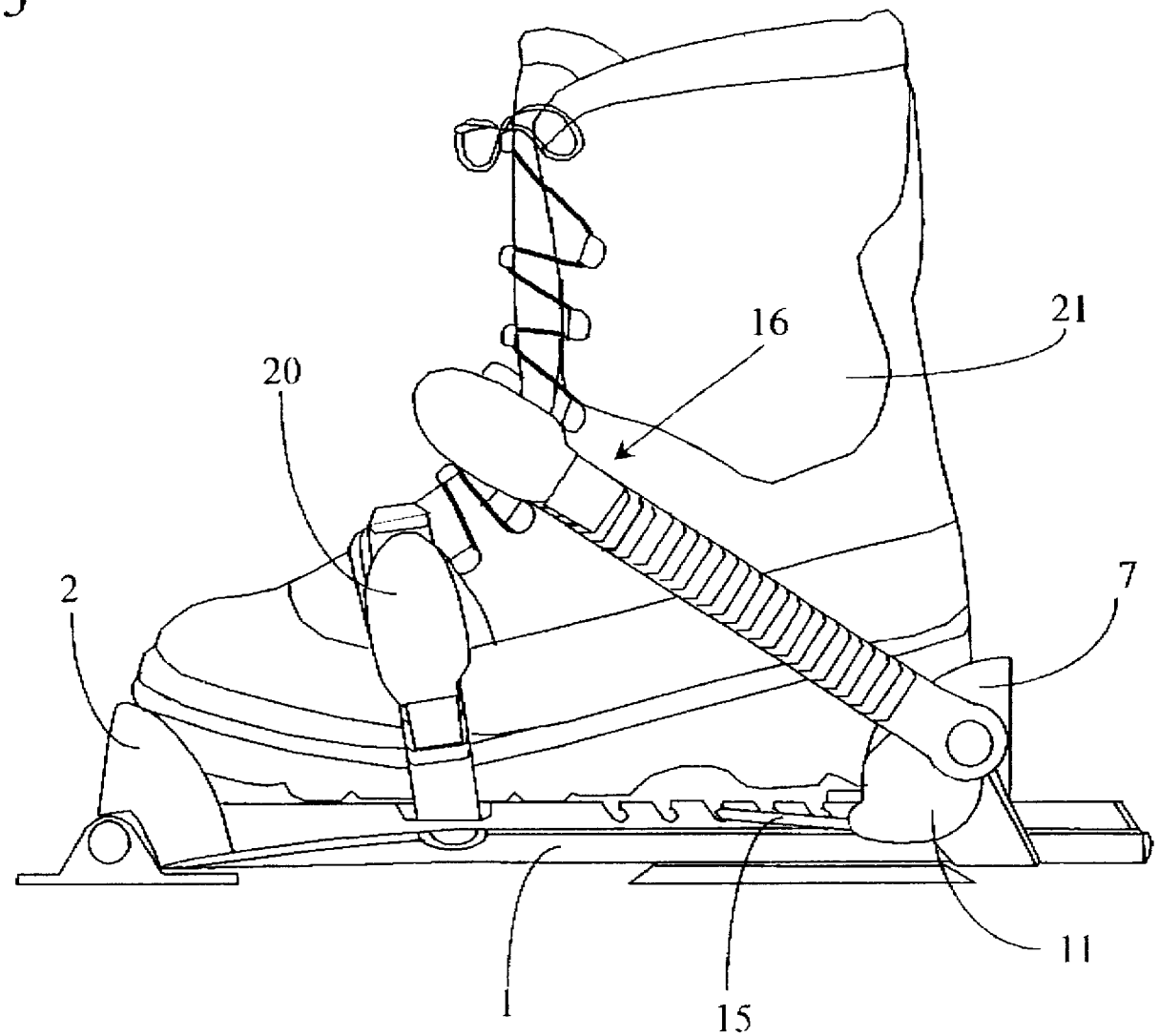

Once the boot is resting on the base plate 1, the intermediate strap 20 is tightened, which will hold the front part of the boot against the base plate 1, as shown in FIG. 5. The next step is to hook up the strap 16 by passing it diagonally over the instep of the boot.

Figure 6:
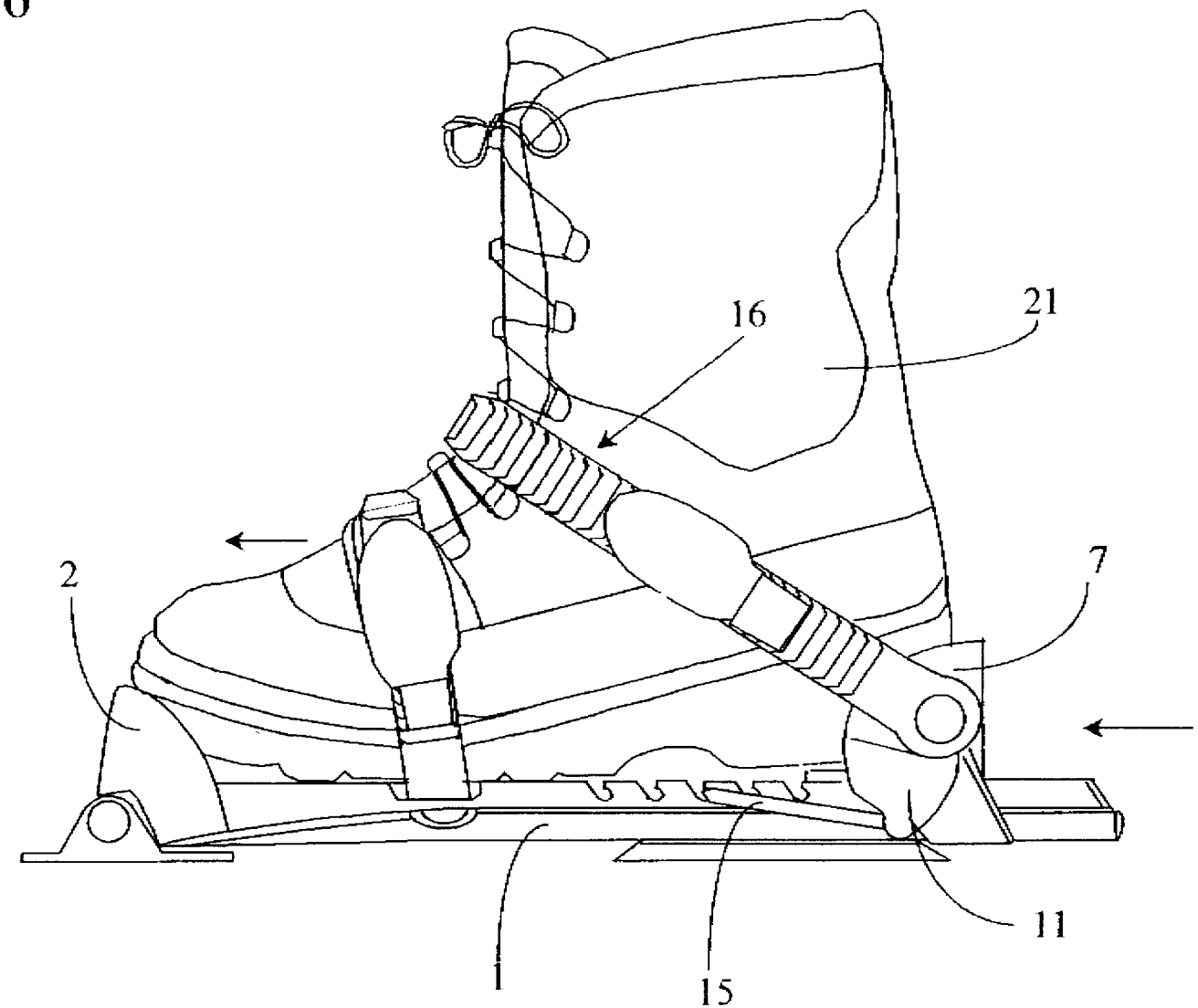

Finally, the strap 16 is tightened as shown in FIG. 6. During this tightening operation, the traction on the levers 11 and 12 has the effect of causing them to pivot about the ends 13 and 14 of the small arch 15 held in the rack 6. This pivoting has the effect of biasing the heelpiece 7 forward. Through the lever effect, the component parallel to the base plate 1 of the forces exerted on the axes 10 is substantially greater than the traction force on the strap 16. The boot 21 is thus firmly held between the front stop 2 and the heelpiece 7. The maximum travel of the heelpiece is approximately 25 mm in the example shown.

Depending on the length of the upper arms of the levers, this travel may vary between 20 and 30 mm.

The heelpiece could be equipped with a stirrup piece intended to hook onto the rear curb of a boot.

The heelpiece 7 could have a rear support element for the leg.

Although illustrative embodiments of the invention have been shown and described, a wide range of modification, change and substitution is contemplated in the foregoing disclosure and in some instances, some features of the present invention may employed without a corresponding use of the other features. Accordingly, it is appropriate that the appended claims be construed broadly and in a manner consistent with the scope of the invention.

What is claimed is:

1. A snow-sport binding device for securing a boot, the device comprising a base plate (1) having front retention means (2) and rear retention means comprising a heelpiece (7) slidably mounted on the base plate and a traction strap (16) mounted to the heelpiece, wherein the base plate (1) is equipped with a rack (6) over a portion of its length and wherein the heelpiece (7) is equipped, on each side, with a lever (11, 12) having an upper and lower arm, the lever articulated at an intermediate point on the heelpiece about an axis (10) transverse to the base plate, the lower arms of these levers being connected to the ends (13, 14) of a catch (15) which hooks into the rack of the base plate, and the upper arms of said levers being connected to the traction strap (16) which passes diagonally over the instep of the boot, wherein when the traction strap (16) is tightened, the upper arm of said levers rotate toward the front of the binding.

2. The binding device as claimed in claim 1, wherein, for a specific position of the catch (15) in the rack, the rearmost position of the heelpiece (7) corresponds to a position of the catch which is parallel to the base plate.

3. The binding device as claimed in claim 1, wherein the maximum displacement of the points of articulation of the catch (15) on the levers (11) during rotation of these levers is greater than the pitch of the rack.

4. The binding device as claimed in one of claims 1 to 3, wherein the distance between a forwardmost and a rearwardmost longitudinal position of the heelpiece is between 20 and 30 mm.

5. The binding device as claimed in one of claims 1 to 3, which carries, between the front and rear retention means, intermediate retention means (20) for holding the boot perpendicularly to the base plate, and wherein the front retention means comprises a fixed stop (2).

6. The binding device as claimed in claim 4, which carries, between the front and rear retention means, intermediate retention means (20) for holding the boot perpendicularly to the base plate, and wherein the front retention means comprises a fixed stop (2).

7. The binding device as claimed in claim 5, wherein the intermediate retention means comprises a strap (20).

8. The binding device as claimed in one of claims 1 to 3, wherein the heelpiece comprises a catch intended for hooking over the rear curb of a boot.

9. The binding device as claimed in claim 4, wherein the heelpiece comprises a catch intended for hooking over the rear curb of a boot.

10. The binding device as claimed in claim 5, wherein the heelpiece comprises a catch intended for hooking over the rear curb of a boot.

11. The binding device as claimed in claim 7, wherein the heelpiece comprises a catch intended for hooking over the rear curb of a boot.

12. The binding device as claimed in one of claims 1 to 3, wherein the heelpiece (7) has a vertical wall which is curved so as to match the rounded heel of a boot.

13. The binding device as claimed in claim 4, wherein the heelpiece (7) has a vertical wall which is curved so as to match the rounded heel of a boot.

14. The binding device as claimed in claim 5, wherein the heelpiece (7) has a vertical wall which is curved so as to match the rounded heel of a boot.

15. The binding device as claimed in claim 6, wherein the heelpiece (7) has a vertical wall which is curved so as to match the rounded heel of a boot.

* * * * *